US010531523B2

(12) United States Patent
Zhou

(10) Patent No.: US 10,531,523 B2
(45) Date of Patent: Jan. 7, 2020

(54) MICROWAVE HEATING APPARATUS

(71) Applicants: GUANGDONG MIDEA KITCHEN APPLIANCES MANUFACTURING CO., LTD., Foshan (CN); MIDEA GROUP CO., LTD., Foshan (CN)

(72) Inventor: Jianyi Zhou, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 1091 days.

(21) Appl. No.: 14/865,566

(22) Filed: Sep. 25, 2015

(65) Prior Publication Data

US 2017/0086262 A1 Mar. 23, 2017

(30) Foreign Application Priority Data

Sep. 21, 2015 (CN) ..... 2015 1 0603632
Sep. 21, 2015 (CN) ..... 2015 2 0732504 U

(51) Int. Cl.
*H05B 6/64* (2006.01)
*H05B 6/80* (2006.01)

(52) U.S. Cl.
CPC ..... *H05B 6/6417* (2013.01); *H05B 6/6402* (2013.01); *H05B 6/6414* (2013.01); *H05B 6/6435* (2013.01); *H05B 6/80* (2013.01)

(58) Field of Classification Search
CPC ..... H05B 6/12–129; H05B 6/6402; H05B 6/6414; H05B 6/6417; H05B 6/6435; H05B 6/80; A21B 1/00
See application file for complete search history.

(56) References Cited

U.S. PATENT DOCUMENTS

2005/0173426 A1* 8/2005 Iwamoto ..... H05B 6/6402 219/752
2009/0140622 A1 6/2009 Seutsugu
(Continued)

FOREIGN PATENT DOCUMENTS

CN 1265457 A 9/2000
CN 101359231 A 8/2007
(Continued)

OTHER PUBLICATIONS

PCT/CN2015/090801 International Search Report & Written Opinion dated Jun. 1, 2016 with brief English translation, 14 pages.
(Continued)

*Primary Examiner* — Ibrahime A Abraham
*Assistant Examiner* — Biniam B Asmelash
(74) *Attorney, Agent, or Firm* — Seed IP Law Group LLP

(57) ABSTRACT

A microwave heating apparatus includes: a body defining a microwave heating chamber therein; a drawer door moveably mounted on the body to open or close the microwave heating chamber; a door switch button disposed on the body or the drawer door and configured to control the drawer door to be opened or closed; a speed adjusting button disposed on the body or the drawer door and configured to control a moving speed of the drawer door; a driving device with a controllable operating speed mounted on one of the body and the drawer door, connected with the other of the body and the drawer door in a transmission way, and configured to drive the drawer door to move; a controller communicated with the door switch button, the speed adjusting button and the driving device respectively.

18 Claims, 6 Drawing Sheets

(56) References Cited

U.S. PATENT DOCUMENTS

| | | | | |
|---|---|---|---|---|
| 2009/0200297 | A1 | 8/2009 | Myoji | |
| 2009/0289057 | A1* | 11/2009 | Yoshidome | F24C 15/02 219/725 |
| 2010/0133263 | A1 | 6/2010 | Toyoda et al. | |
| 2014/0352549 | A1* | 12/2014 | Upston | A47J 37/085 99/334 |

FOREIGN PATENT DOCUMENTS

| | | | |
|---|---|---|---|
| CN | 104456646 | A | 9/2013 |
| CN | 204026764 | U | 12/2014 |
| CN | 204063178 | U | 12/2014 |
| CN | 104456650 | A | 3/2015 |
| CN | 204361946 | U | 5/2015 |
| CN | 205026762 | U | 9/2015 |
| EP | 1544546 | A1 | 12/2003 |
| JP | 2009002527 | A | 1/2009 |

OTHER PUBLICATIONS

Chinese Patent Application No. 201510603632.1, First Office Action dated Feb. 7, 2017, with English translation, 11 pages.

* cited by examiner

MICROWAVE HEATING APPARATUS

CROSS-REFERENCE TO RELATED APPLICATIONS

This application claims priority to and benefits of the following applications:

1) Chinese Patent Application Serial No. 201510603632.1, filed with the State Intellectual Property Office of P. R. China on Sep. 21, 2015;

2) Chinese Patent Application Serial No. 201520732504.2, filed with the State Intellectual Property Office of P. R. China on Sep. 21, 2015.

The entire contents of the above applications are incorporated herein by reference.

FIELD

The present invention relates to a household appliance field, and more particularly to a microwave heating apparatus.

BACKGROUND

A microwave heating apparatus with a drawer door is described in the related art, and the drawer doors of some microwave heating apparatuses easily collide with bodies of the microwave heating apparatuses in opening or closing the drawer doors, which causes a liquid in the drawer door to spill out. Furthermore, the time of opening or closing the drawer door of the microwave heating apparatus is long so as to affect the satisfaction of users.

SUMMARY

Embodiments of the present invention seek to solve at least one of the problems existing in the related art. Therefore, the present invention provides a microwave heating apparatus, in which a drawer door may be opened or closed at different speeds as needed.

The microwave heating apparatus according to embodiments of the present invention includes: a body defining a microwave heating chamber therein; a drawer door moveably mounted on the body to open or close the microwave heating chamber; a door switch button disposed on the body or the drawer door and configured to control the drawer door to be opened or closed; a speed adjusting button disposed on the body or the drawer door and configured to control a moving speed of the drawer door; a driving device with a controllable operating speed mounted on one of the body and the drawer door, connected with the other of the body and the drawer door in a transmission way, and configured to drive the drawer door to move; a controller communicated with the door switch button, the speed adjusting button and the driving device respectively.

With the microwave heating apparatus according to embodiments of the present invention, it is possible to select a suitable speed for opening or closing the drawer door by the speed adjusting button as needed, which facilitates the operation and use, improves the satisfactions of the users and improves the safety and convenience of the microwave heating apparatus.

In some embodiments, the controller includes a gear selection module configured to control the driving device to run at different speeds, the gear selection module is communicated with the speed adjusting button and the driving device respectively.

In some embodiments, the controller further includes a timing module configured to detect a continuous touch time of the speed adjusting button, the timing module is communicated with the speed adjusting button and the gear selection module respectively.

In some embodiments, a gear level of the gear selection module is inversely proportional to the continuous touch time of the speed adjusting button.

In some embodiments, the gear selection module has a first gear, a second gear and a third gear, the gear selection module is in the first gear when the continuous touch time of the speed adjusting button is in a first range, in the second gear when the continuous touch time of the speed adjusting button is in a second range, and in the third gear when the continuous touch time of the speed adjusting button is in a third range.

In some embodiments, the speed adjusting button and the door switch button are integrally formed.

In some embodiments, a plurality of the speed adjusting buttons are provided and communicated with the gear selection module respectively, the gear selection module is in different gears when different speed adjusting buttons are touched.

In some embodiments, the gear selection module has a first gear, a second gear and a third gear, the plurality of the speed adjusting buttons include a first speed adjusting button, a second speed adjusting button and a third speed adjusting button, the gear selection module is in the first gear when the first speed adjusting button is touched, in the second gear when the second speed adjusting button is touched, and in the third gear when the third speed adjusting button is touched.

In some embodiments, the gear selection module is in the first gear when none of the first speed adjusting button, the second speed adjusting button and the third speed adjusting button are touched.

In some embodiments, the microwave heating apparatus further includes a control box disposed on the body and positioned above the drawer door, the speed adjusting button and the door switch button being disposed on the control box.

In some embodiments, the speed adjusting button and the door switch button are touch sensitive buttons.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
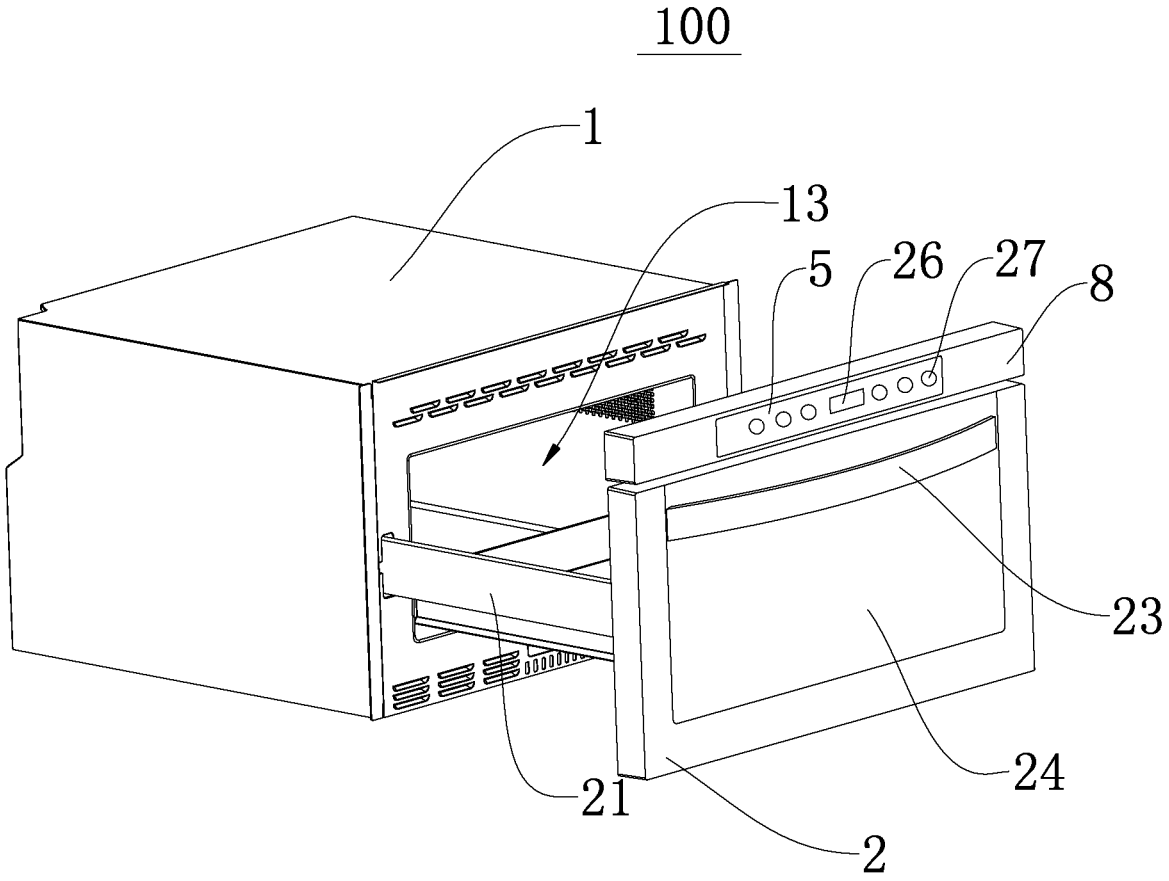
FIG. 1 is a schematic view of a microwave heating apparatus according to an embodiment of the present invention.
Figure 2:
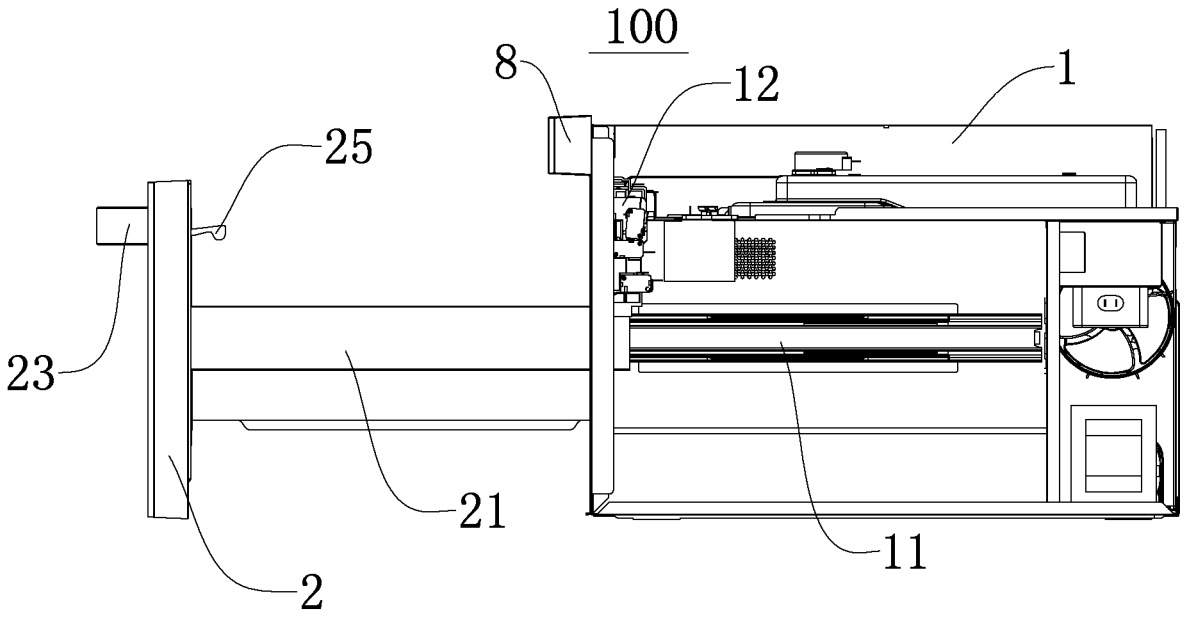
FIG. 2 is a schematic view of a side of a microwave heating apparatus according to an embodiment of the present invention.

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the specification, it is to be understood that terms such as "upper," "lower," "front," "rear," "left," "right," "vertical," "horizontal," "top," "bottom," "inner," and "outer" should be construed to refer to the orientation as then described or as shown in the drawings under discussion. These relative terms are for convenience of description and do not require that the present invention be constructed or operated in a particular orientation, thus shall not be construed to limit the present invention.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means at least two, e.g. two, three and so on, unless specified otherwise.

With reference to FIG. 1 to FIG. 7, a microwave heating apparatus 100 according to embodiments of the present invention will be described below. Specifically, the microwave heating apparatus 100 may be a microwave oven or a microwave baker imbedded in a wall or a cabinet.

As shown in FIG. 1 to FIG. 7, the microwave heating apparatus 100 according to embodiments of the present invention includes a body 1, a drawer door 2, a door switch button 26, a speed adjusting button 27, a driving device 6 and a controller 7.

As shown in FIG. 1, a microwave heating chamber 13 is defined in the body 1. The drawer door 2 may be moveably mounted on the body 1 to open or close the microwave heating chamber 13. A handle 23 and a window 24 are disposed on the drawer door 2, which facilitates the operation and observation of users.

The speed adjusting button 27 is disposed on the body 1 or the drawer door 2 and configured to control a moving speed of the drawer door 2. In this way, when the opening or closing operation is performed, the opening or closing speed of the drawer door 2 may be controllable. For example, when a liquid is heated in the microwave heating apparatus 100, in order to prevent the liquid from spilling out due to the collision between the drawer door 2 and the body 1, the drawer door 2 needs to move slowly, that is, a smaller speed needs to be selected at this time to open or close the drawer door 2. In normal use, the moving speed of the drawer door 2 when being opened or closed can be increased, which decreases the time of opening or closing the drawer door 2, thereby reducing the waiting time for users. Thus, by the speed adjusting button 27, a suitable speed of opening or closing the drawer door 2 may be selected according to the needs of the user, which brings convenience to the users and improves the satisfaction of the users.

Figure 3:
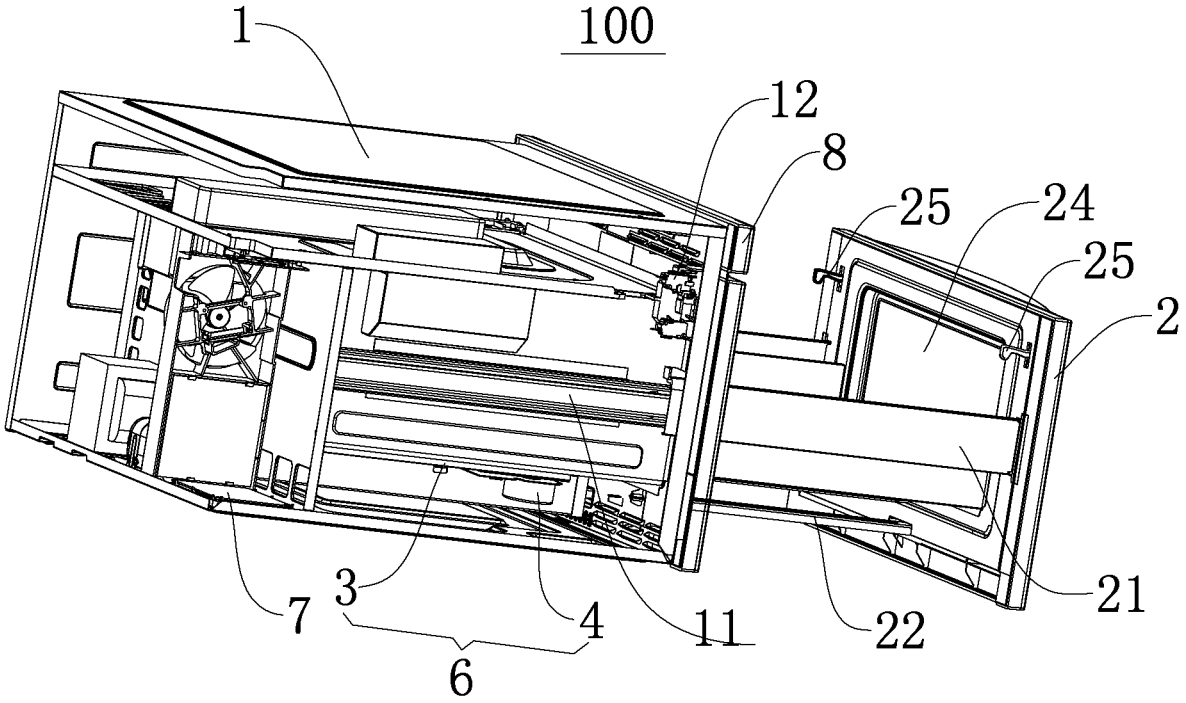
FIG. 3 is a schematic view of another side of a microwave heating apparatus according to an embodiment of the present invention.

The driving device 6 is mounted on one of the body 1 and the drawer door 2, and connected with the other of the body 1 and the drawer door 2 in a transmission way, and may be configured to drive the drawer door 2 to move. The speed of the driving device 6 is controllable to control the moving speed of the drawer door 2. In the example as shown in FIG. 3, rail connection plates 21 are disposed at left and right sides of the drawer door 2 respectively, and rails 11 are disposed on left and right side walls of the microwave heating chamber 13 respectively. The rail connection plates 21 may cooperated with the rails 11 to move in the body 1. As shown in FIG. 3, the driving device may include a pusher 3 and a motor 4. The pusher 3 is disposed in the body 1 and driven by the motor 4. The motor 4 is disposed in body 1. The pusher 3 is connected to the drawer door 2 via a pushrod 22. The pusher 3 may convert a rotational movement of the motor 4 into a linear movement of the pushrod 22 so as to push or pull the drawer door 2 to move, so as to realize the closing or opening of the drawer door 2.

The door switch button 26 is disposed on the body 1 or the drawer door 2 and configured to control the drawer door 2 to be opened or closed. A hook 25 is disposed on the drawer door 2. An interlocking bracket 12 is disposed in the body 1. When the drawer door 2 is closed, the hook 25 is snap-fitted with the interlocking bracket 12 closely, at this moment the microwave heating apparatus 100 starts to work.

The controller 7 is communicated with the door switch button 26, the speed adjusting button 27 and the driving device 6 respectively. In this way, the user selects to open or close the drawer door 2 by the door switch button 26 and selects the moving speed of the drawer door 2 by the speed adjusting button 27 as needed. The controller 7 may control the driving device 6 according to signals from the door switch button 26 and the speed adjusting button 27 so as to control the opening or closing operation and the moving speed of the drawer door 2.

With the microwave heating apparatus 100 according to embodiments of the present invention, it is possible to select a suitable speed for opening or closing the drawer door 2 by the speed adjusting button 27 as needed, which facilitates the operation and use, improves the satisfactions of the users and improves the safety and convenience of the microwave heating apparatus 100.

In some embodiments of the present invention, the controller 7 includes a gear selection module 71 configured to control the driving device 6 to run at different speeds, the gear selection module 71 is communicated with the speed adjusting button 27 and the driving device 6 respectively. The gear selection module 71 may have a plurality of gears, in which the plurality of gears are corresponding to different running speeds of the drawer door 2. In this way, the speed adjusting button 27 may control the gear of the gear selection module 71, the controller 7 controls the driving device 6 based on the gear of the gear selection module 71, and the driving device 6 drives the drawer door 2 to run at different speeds.

Figure 6:
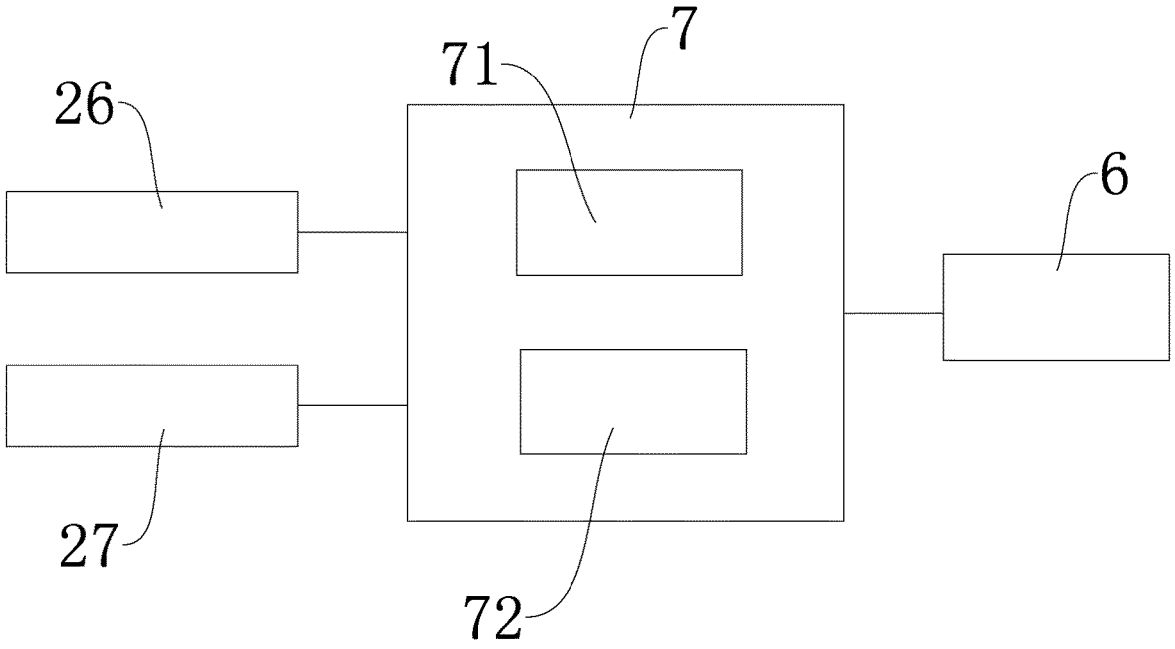
FIG. 6 is a block diagram of a controller of a microwave heating apparatus according to an embodiment of the present invention.

In some embodiments of the present invention as shown in FIG. 6, the controller 7 further includes a timing module 72 configured to detect a continuous touch time t of the speed adjusting button 27, the timing module 72 is communicated with the speed adjusting button 27 and the gear selection module 71 respectively. The continuous touch time t of the speed adjusting button 27 detected by the timing module 72 may be divided into a plurality of ranges, the plurality of ranges are corresponding to a plurality of gears of the gear selection module 71. In this way, the gear of the gear selection module 71 may be determined according to the continuous touch time t of the speed adjusting button 27 detected by the timing module 72 so as to control the moving speed of the drawer door 2.

Alternatively, the gear level of the gear selection module 71 is inversely proportional to the continuous touch time t of the speed adjusting button 27. In other words, the continuous touch time t of the speed adjusting button 27 is inversely proportional to the moving speed of the drawer door 2, that is, the longer the continuous touch time t of the speed adjusting button 27 is, the smaller the selected moving speed of the drawer door 2 is, and the longer the time needed to open or close the drawer door 2 is.

In some specific embodiments of the present invention, the gear selection module 71 may have a first gear, a second gear and a third gear, and the touch time of the speed adjusting button 27 may be divided into three ranges correspondingly. When the continuous touch time t of the speed adjusting button 27 is in a first range, the gear selection module 71 is in the first gear. When the continuous touch time t of the speed adjusting button 27 is in a second range, the gear selection module 71 is in the second gear. When the continuous touch time t of the speed adjusting button 27 is in a third range, the gear selection module 71 is in the third gear. The first range, the second range and the third range are increased in turn, and the moving speeds of the drawer door 2 corresponding to the first gear, the second gear and the third gear are decreased in turn.

Figure 4:
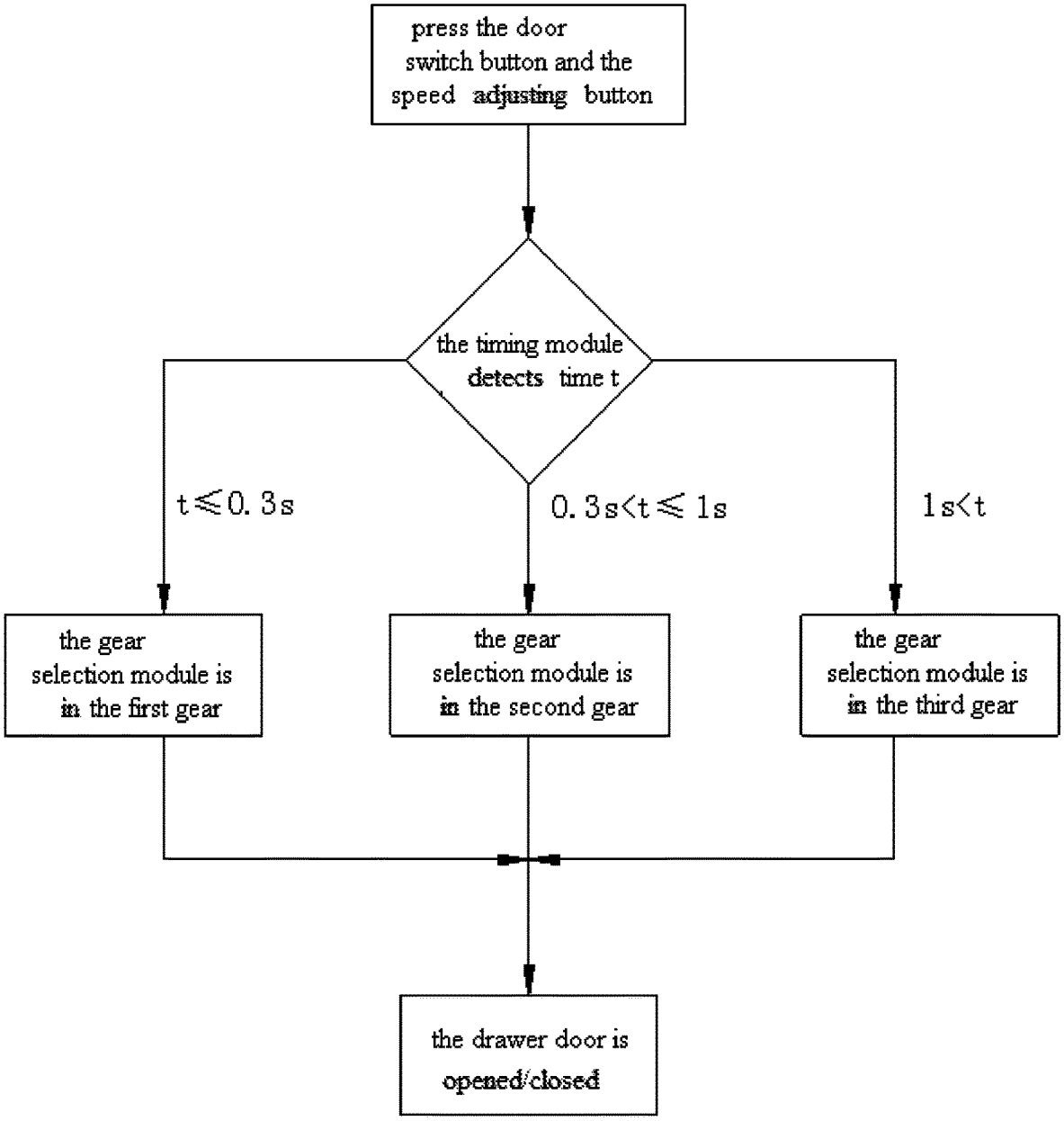
FIG. 4 is a control flow chart of a microwave heating apparatus according to an embodiment of the present invention.

In some specific embodiments of the present invention, as shown in FIG. 4, the maximum moving stroke of the drawer door 2 is 390 mm. The first range is from 0 to 0.3 sec, when the gear selection module 71 is in the first gear, the driving device 6 is controlled to drive the drawer door 2 to move at a speed of 130 mm/sec, i.e., the drawer door 2 can complete the maximum moving stroke in 3 seconds. The second range is from 0.3 to 1 sec, when the gear selection module 71 is in the second gear, the driving device 6 is controlled to drive the drawer door 2 to move at a speed of 78 mm/sec, i.e., the drawer door 2 can complete the maximum moving stroke in 5 seconds. The third range is from 1 sec to infinity, when the gear selection module 71 is in the third gear, the driving device 6 is controlled to drive the drawer door 2 to move at a speed of 65 mm/sec, i.e., the drawer door 2 can complete the maximum moving stroke in 6 seconds.

Alternatively, the speed adjusting button 27 and the door switch button 26 are integrally formed. Thus, it is possible to simplify the control step of the microwave heating apparatus 100 and to facilitate the operation of the users.

Referring to FIG. 4, a control flow of the microwave heating apparatus 100 according to an embodiment of the present invention will be described below.

When the user presses the door switch button 26 and the speed adjusting button 27, the timing module 72 detects the continuous touch time t of the speed adjusting button 27. Based on a range corresponding to the time detected by the timing module 72, the gear selection module 71 selects different gears. When the time detected by the timing module 72 is in the first range, the gear selection module 71 is in the first gear and the driving device 6 drives the drawer door 2 to move at a speed of the first gear. When the time detected by the timing module 72 is in the second range, the gear selection module 71 is in the second gear and the driving device 6 drives the drawer door 2 to move at a speed of the second gear. When the time detected by the timing module 72 is in the third range, the gear selection module 71 is in the third gear and the driving device 6 drives the drawer door 2 to move at a speed of the third gear. Thus, the user can select different speeds to open or close the drawer door 2 as needed.

Figure 7:
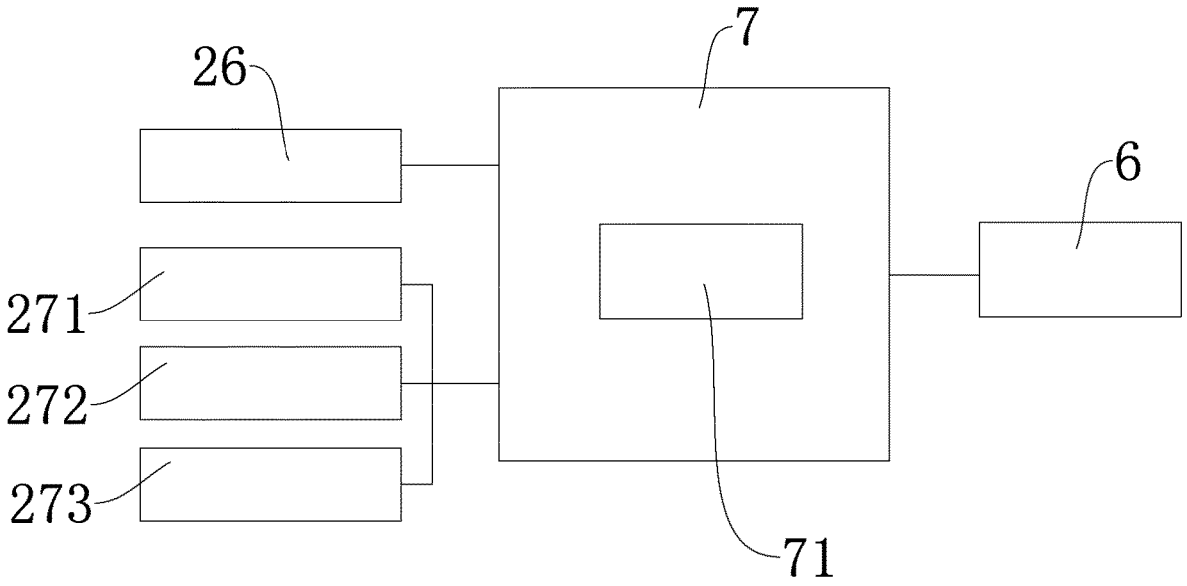
FIG. 7 is a block diagram of a controller of a microwave heating apparatus according to another embodiment of the present invention.

In another embodiment of the present invention, as shown in FIG. 7, a plurality of the speed adjusting buttons 27 are provided and communicated with the gear selection module 71 respectively. When different speed adjusting buttons 27 are touched, the gear selection module 71 is in different gears. The user may set the speed of the plurality of the speed adjusting buttons 27 as needed, and selects different speed adjusting buttons 27, i.e., selects different running speeds for the drawer door 2.

In some embodiments of the present invention, the gear selection module 71 may have a first gear, a second gear and a third gear. The plurality of the speed adjusting buttons 27 may include a first speed adjusting button 271, a second speed adjusting button 272 and a third speed adjusting button 273. When the first speed adjusting button 271 is touched, the gear selection module 71 is in the first gear and the driving device 6 drives the drawer door 2 to move at a speed of the first gear. When the second speed adjusting button 272 is touched, the gear selection module 71 is in the second gear and the driving device 6 drives the drawer door 2 to move at a speed of the second gear. When the third speed adjusting button 273 is touched, the gear selection module 71 is in the third gear and the driving device 6 drives the drawer door 2 to move at a speed of the third gear.

Figure 5:
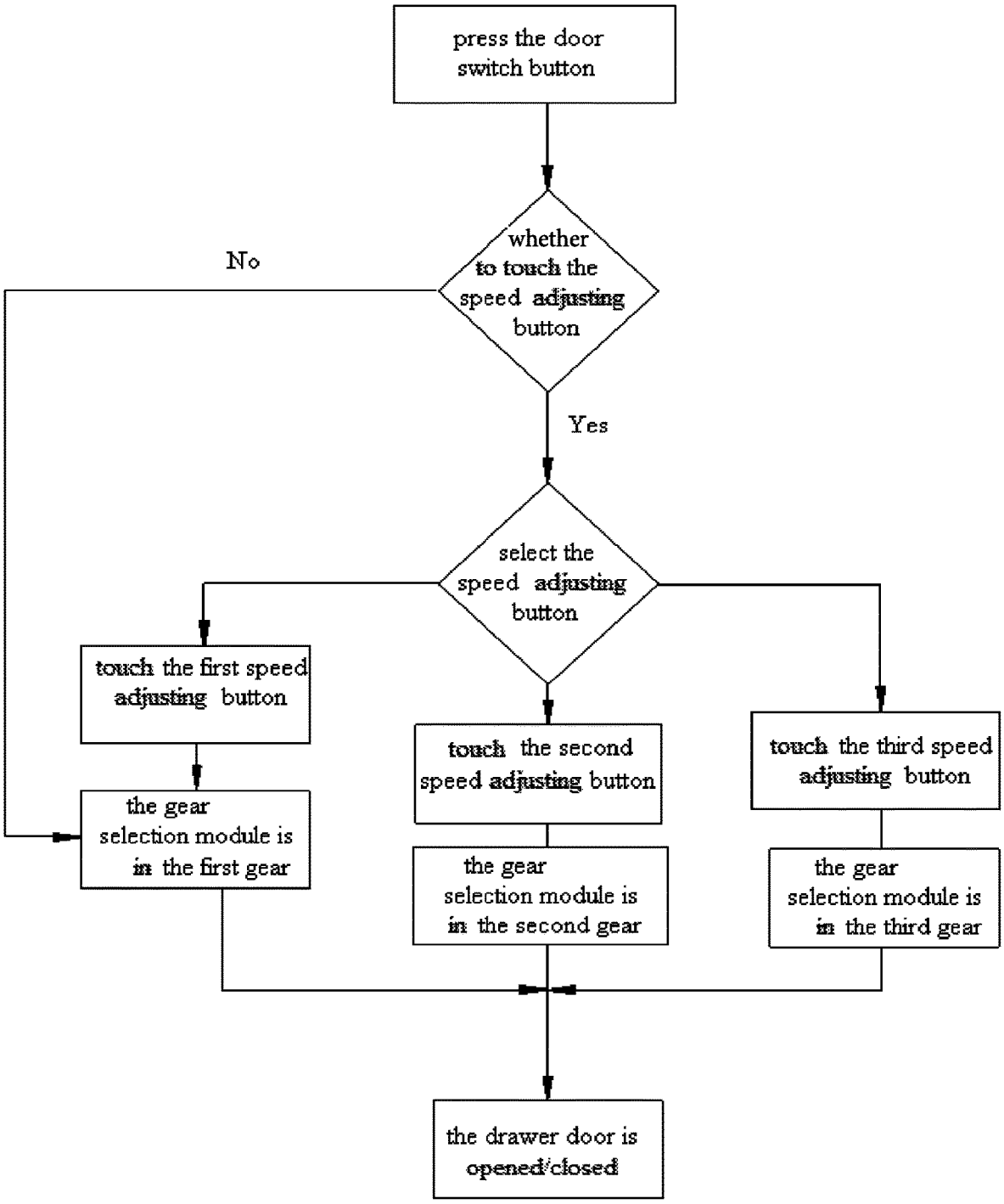
FIG. 5 is a control flow chart of a microwave heating apparatus according to another embodiment of the present invention.

In an embodiment of the present invention, as shown in FIG. 5, the maximum moving stroke of the drawer door 2 may be 390 mm. When the gear selection module 71 is in the first gear, the driving device 6 is controlled to drive the drawer door 2 to move at a speed of 130 mm/sec. When the gear selection module 71 is in the second gear, the driving device 6 is controlled to drive the drawer door 2 to move at a speed of 78 mm/sec. When the gear selection module 71 is in the third gear, the driving device 6 is controlled to drive the drawer door 2 to move at a speed of 65 mm/sec.

Therefore, when the first speed adjusting button 271 is touched, the driving device 6 drives the drawer door 2 to move at a speed of 130 mm/sec; when the second speed adjusting button 272 is touched, the driving device 6 drives the drawer door 2 to move at a speed of 78 mm/sec; when the third speed adjusting button 273 is touched, the driving device 6 drives the drawer door 2 to move at a speed of 65 mm/sec.

Alternatively, the gear selection module 71 is in the first gear when none of the first speed adjusting button 271, the second speed adjusting button 272 and the third speed adjusting button 273 are touched. That is, when the user does not select the speed adjusting button 27, the gear selection module 71 is in the first gear by default and the driving device 6 drives the drawer door 2 to move at a speed of 130 mm/sec. Thus, when the user does not select to adjust the speed actively, the drawer door 2 is opened at a fastest speed.

Referring to FIG. 5, a working process of the microwave heating apparatus 100 according to an embodiment of the present invention will be described below.

Firstly, the user selects to open or close the drawer door 2 based on practical situations and presses the door switch button 26, and then determines whether to select the speed adjusting button 27. The user may touch the first speed adjusting button 271, the second speed adjusting button 272 or the third speed adjusting button 273 to open or close the drawer door 2 as needed. When the user does not touch the speed adjusting button 27, the drawer door 2 runs at the speed of the first gear when the first speed adjusting button 271 is touched so as to perform the opening and closing of the drawer door 2.

In an embodiment of the present invention, the microwave heating apparatus 100 further includes a control box 8 disposed on the body 1 and positioned above the drawer door 2. Both the speed adjusting button 27 and the door switch button 26 are disposed on the control box 8. Alternatively, the speed adjusting button 27 and the door switch button 26 are disposed at a side of the control box 8 facing toward the user, such that it is convenient for the user to operate the speed adjusting button 27 and the door switch button 26.

In an embodiment of the present invention, the speed adjusting button 27 and the door switch button 26 are touch sensitive buttons. Thus, the adjustment and control of the speed adjusting button 27 and the door switch button 26 may be realized by manual touch, which facilitates the operation of the user and simplifies the structure of the microwave heating apparatus 100. Alternatively, as shown in FIG. 1, a control panel 5 may be disposed at the side of the control box 8 facing toward the user, the speed adjusting button 27 and the door switch button 26 may be both positioned on the control panel 5.

Other structures and operations of the microwave heating apparatus 100 according to embodiments of the present invention are known to those skilled in the art, and thus will not be described in detail here.

In the description of the present invention, it should be understood that, unless specified or limited otherwise, the terms "mounted," "supported," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present invention.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the phrases in various places throughout this specification are not necessarily referring to the same embodiment or example of the present invention. Furthermore, the particular features, structures, materials, or characteristics may be combined in any suitable manner in one or more embodiments or examples. In addition, those skilled in the art may combine and composite different embodiments or examples and features of various embodiments or examples embodiment described in the description with no conflicting situation.

Although explanatory embodiments have been shown and described, it would be appreciated by those skilled in the art that the above embodiments are exemplary and may not be construed to limit the present invention, and changes, alternatives, and modifications may be made in the embodiments within the scope of the present invention.

What is claimed is:

1. A microwave heating apparatus, comprising:

a body defining a microwave heating chamber therein;

a drawer door moveably mounted on the body to open or close the microwave heating chamber;

a door switch button disposed on the body or the drawer door and configured to control the drawer door to be opened or closed;

a speed adjusting button disposed on the body or the drawer door;

a driving device coupled to the body and the drawer door, the driving device configured to drive the drawer door to move; and a controller in communication with the door switch button, the speed adjusting button and the driving device respectively, the controller including:

a gear selection module coupled to the speed adjusting button and the driving device, the gear selection module includes a plurality of gears, each respective gear of the plurality of gears corresponding to a respective moving speed of a plurality of moving speeds of the drawer door; and a timing module coupled to the speed adjusting button and the gear selection module, the timing module configured to detect a continuous touch time of the speed adjusting button to select one of the plurality of gears.

2. The microwave heating apparatus according to claim 1, wherein the respective gears of the plurality of gears are inversely proportional to the continuous touch time of the speed adjusting button.

3. The microwave heating apparatus according to claim 2, wherein the plurality of gears includes a first gear, a second gear and a third gear, the gear selection module is in the first gear when the continuous touch time of the speed adjusting button is in a first range, in the second gear when the continuous touch time of the speed adjusting button is in a second range, and in the third gear when the continuous touch time of the speed adjusting button is in a third range.

4. The microwave heating apparatus according to claim 1, wherein the speed adjusting button and the door switch button are integrally formed.

5. The microwave heating apparatus according to claim 1, wherein the speed adjusting button is one of a plurality of the speed adjusting buttons provided and communicated with the gear selection module respectively, the gear selection module is in different gears when different speed adjusting buttons are touched.

6. The microwave heating apparatus according to claim 5, wherein the gear selection module has a first gear, a second gear and a third gear, the plurality of the speed adjusting buttons comprise a first speed adjusting button, a second speed adjusting button and a third speed adjusting button, the gear selection module is in the first gear when the first speed adjusting button is touched, in the second gear when the second speed adjusting button is touched, and in the third gear when the third speed adjusting button is touched.

7. The microwave heating apparatus according to claim 6, wherein the gear selection module is in the first gear when none of the first speed adjusting button, the second speed adjusting button and the third speed adjusting button are touched.

8. The microwave heating apparatus according to claim 1, further comprising a control box disposed on the body and positioned above the drawer door, the speed adjusting button and the door switch button being disposed on the control box.

9. The microwave heating apparatus according to claim 1, further comprising a control box disposed on the body and positioned above the drawer door, the speed adjusting button and the door switch button being disposed on the control box.

10. The microwave heating apparatus according to claim 1, further comprising a control box disposed on the body and positioned above the drawer door, the speed adjusting button and the door switch button being disposed on the control box.

11. The microwave heating apparatus according to claim 2, further comprising a control box disposed on the body and positioned above the drawer door, the speed adjusting button and the door switch button being disposed on the control box.

12. The microwave heating apparatus according to claim 3, further comprising a control box disposed on the body and positioned above the drawer door, the speed adjusting button and the door switch button being disposed on the control box.

13. The microwave heating apparatus according to claim 1, wherein the speed adjusting button and the door switch button are touch sensitive buttons.

14. The microwave heating apparatus according to claim 1, wherein the speed adjusting button and the door switch button are touch sensitive buttons.

15. The microwave heating apparatus according to claim 1, wherein the speed adjusting button and the door switch button are touch sensitive buttons.

16. The microwave heating apparatus according to claim 2, wherein the speed adjusting button and the door switch button are touch sensitive buttons.

17. The microwave heating apparatus according to claim 3, wherein the speed adjusting button and the door switch button are touch sensitive buttons.

18. The microwave heating apparatus according to claim 4, wherein the speed adjusting button and the door switch button are touch sensitive buttons.

* * * * *